US009898986B2

(12) United States Patent
Ji et al.

(10) Patent No.: US 9,898,986 B2
(45) Date of Patent: Feb. 20, 2018

(54) DISPLAY DEVICE CAPABLE OF PERFORMING BLACK FRAME INSERTION

(71) Applicants: Shenzhen China Star Optoelectronics Technology Co., Ltd., Shenzhen, Guangdong (CN); Wuhan China Star Optoelectronics Technology Co., Ltd., Wuhan, Hubei (CN)

(72) Inventors: Feilin Ji, Guangdong (CN); Jiehui Qin, Guangdong (CN)

(73) Assignees: Shenzhen China Star Optoelectronics Technology Co., Ltd, Shenzhen, Guangdong (CN); Wuhan China Star Optoelectronics Technology Co., Ltd., Wuhan, Hubei (CN)

( * ) Notice: Subject to any disclaimer, the term of this patent is extended or adjusted under 35 U.S.C. 154(b) by 146 days.

(21) Appl. No.: 14/781,434

(22) PCT Filed: Jun. 24, 2015

(86) PCT No.: PCT/CN2015/082205
§ 371 (c)(1),
(2) Date: Sep. 30, 2015

(87) PCT Pub. No.: WO2016/197408
PCT Pub. Date: Dec. 15, 2016

(65) Prior Publication Data

US 2017/0154592 A1 Jun. 1, 2017

(30) Foreign Application Priority Data

Jun. 8, 2015 (CN) ..... 2015 1 0310336

(51) Int. Cl.
*G09G 3/36* (2006.01)

(52) U.S. Cl.
CPC ..... *G09G 3/3677* (2013.01); *G09G 3/3618* (2013.01); *G09G 3/3696* (2013.01); (Continued)

(58) Field of Classification Search
CPC ..... G09G 2310/027; G09G 2310/0291–2310/0297; H04N 1/32251
See application file for complete search history.

(56) References Cited

U.S. PATENT DOCUMENTS

2003/0227428 A1* 12/2003 Nose ..... G09G 3/3614 345/90
2007/0296658 A1* 12/2007 Kim ..... G09G 3/3648 345/87
2008/0238897 A1* 10/2008 Kimura ..... G09G 3/3614 345/204

* cited by examiner

*Primary Examiner* — Sanghyuk Park
(74) *Attorney, Agent, or Firm* — Andrew C. Cheng

(57) ABSTRACT

The present invention discloses a display device capable of performing black frame insertion. The gamma circuit comprises an either-or multiplex selector. The input data of one input end of the selector is a VCOM voltage outputted by the gamma circuit, and the input data of the other input end of the selector is a voltage converted from a predetermined value after digital to analog conversion stored in a multi time programmable memory of the gamma circuit. As the selector selects the VCOM voltage outputted by the gamma circuit under control of the control port, the outputted VCOM voltage is amplified by an operational amplifier in the gamma circuit and then outputted to the source driving circuit to be a first gamma reference voltage which is required as the source driving circuit performs digital to analog conversion.

7 Claims, 3 Drawing Sheets

(52) U.S. Cl.
CPC ..... *G09G 2310/0245* (2013.01); *G09G 2310/0297* (2013.01); *G09G 2310/08* (2013.01); *G09G 2320/0673* (2013.01); *G09G 2330/021* (2013.01)

DISPLAY DEVICE CAPABLE OF PERFORMING BLACK FRAME INSERTION

CROSS REFERENCE

This application claims the priority of Chinese Patent Application No. 201510310336.2, entitled "Display device capable of performing black frame insertion", filed on Jun. 8, 2015, the disclosure of which is incorporated herein by reference in its entirety.

FIELD OF THE INVENTION

The present invention relates to a display device technology field, and more particularly to a display device capable of performing black frame insertion.

BACKGROUND OF THE INVENTION

With the constant development of the LCD display technology, the requirements for the image display effect of the display panel get higher and higher either for the general consumers or the practitioners in the liquid crystal display industry. The demands for the respective specifications of the liquid crystal display panel also become more and more critical. As well known, the lowest refresh rate of the display panel is 60 Hz, and the period of showing one frame of image is about 16.7 ms. However, the serious lagging images can be easily seen in some particular images. Because of being restricted by the slow response time of the liquid crystals, the image refresh rate cannot be promoted for a long time. With the development of the technology, the response time of the liquid crystals gets faster and faster. The promotion for the refresh rate of the image now is possible. Therefore, for solving the lagging image issue, the refresh rate of the image is doubled, and the technology of inserting a black frame in the original two frames becomes possible. Besides, with the development of the liquid crystal display technology, the 3D display technology comes quickly into the daily life of the people. Nevertheless, 3D display has one biggest issue is that the crosstalk happens to the images for the left, right eyes to influence the display effect of 3D. Thus, the black frame insertion skill is also widely applied in the 3D display technology. For raising the refresh rate of the image for the liquid crystal panel, one black frame is inserted between the images for the left, right eyes to prevent the crosstalk.

At present, the black frame insertion technology is achieved with the outputted digital signals by controlling the time sequence control circuit (T-CON). The black frame insertion with T-CON is that the data of one frame is the data of the normal image, and the data of the other frame is 00000000 (i.e. black frame insertion). For example, a frame of normal image is outputted to be the first frame, and a black frame is outputted to be the second frame, and a frame of normal image is outputted to be the third frame, and a black frame is outputted to be the fourth frame, and so on. The drawbacks of the black frame insertion with T-CON is that as outputting the black frame, the T-CON circuit and the source driving circuit still need to perform the transmission of RGB data to increase the power consumption of the display panel.

SUMMARY OF THE INVENTION

The present invention discloses a display device capable of performing black frame insertion which can realize the output of black frame insertion under condition of reducing the power consumption of the display device.

The embodiment of the present invention discloses a display device capable of performing black frame insertion, comprising a display screen, and a gate driving circuit and a source driving circuit coupled to the display screen, a gamma circuit and a time sequence control circuit, wherein the gamma circuit comprises an either-or multiplex selector, and input data of one input end of the either-or multiplex selector is a VCOM voltage outputted by the gamma circuit, and input data of the other input end is a voltage converted from a predetermined value after digital to analog conversion stored in a multi time programmable memory of the gamma circuit, and one general purpose input output port of the time sequence control circuit is assigned to be a control port of controlling output of the either-or multiplex selector, and as the either-or multiplex selector selects the VCOM voltage outputted by the gamma circuit under control of the control port, the outputted VCOM voltage is amplified by an operational amplifier in the gamma circuit and then outputted to the source driving circuit to be a first gamma reference voltage which is required as the source driving circuit performs digital to analog conversion, and the time sequence control circuit does not output data as a gamma reference voltage required when the source driving circuit performs digital to analog conversion is the first gamma reference voltage for realizing output of black frame insertion.

In one embodiment, as the either-or multiplex selector selects outputting the voltage converted from the predetermined value after digital to analog conversion in the multi time programmable memory of the gamma circuit under control of the control port, the outputted voltage after digital to analog conversion is amplified by the operational amplifier and then outputted to the source driving circuit to be a second gamma reference voltage which is required as the source driving circuit performs digital to analog conversion, and the time sequence control circuit transmits normal images when the gamma reference voltage required as the source driving circuit performs digital to analog conversion is the second gamma reference voltage.

In one embodiment, the either-or multiplex selector selects outputting the VCOM voltage outputted by the gamma circuit as the control port is set to be low voltage level, and selects outputting the voltage converted from the predetermined value after digital to analog conversion in the multi time programmable memory of the gamma circuit as the control port is set to be high voltage level.

In one embodiment, the either-or multiplex selector selects outputting the VCOM voltage outputted by the gamma circuit as the control port is set to be high voltage level, and selects outputting the voltage converted from the predetermined value after digital to analog conversion in the multi time programmable memory of the gamma circuit as the control port is set to be low voltage level.

In one embodiment, the time sequence control circuit sets voltage level of the control port to be high voltage level as the display screen requires outputting an odd frame of image, and sets voltage level of the control port to be low voltage level as the display screen requires outputting an even frame of image.

In one embodiment, the time sequence control circuit sets voltage level of the control port to be low voltage level as the display screen requires outputting an odd frame of image, and sets voltage level of the control port to be high voltage level as the display screen requires outputting an even frame of image.

In comparison with prior art, the embodiment of the present invention has benefits below: under condition that the time sequence control circuit does not output data, black frame insertion can be achieved to reduce the power consumption of the time sequence control circuit and the source driving circuit, and thus to reduce the power consumption of the entire display device.

BRIEF DESCRIPTION OF THE DRAWINGS

In order to more clearly illustrate the embodiments of the present invention, the following figures will be described in the embodiments are briefly introduced. It is obvious that the drawings are only some embodiments of the present invention, those of ordinary skill in this field can obtain other figures according to these figures without paying the premise.

DETAILED DESCRIPTION OF PREFERRED EMBODIMENTS

Embodiments of the present invention are described in detail with the technical matters, structural features, achieved objects, and effects with reference to the accompanying drawings as follows. It is clear that the described embodiments are merely part of embodiments of the present invention, but not all embodiments. Based on the embodiments of the present invention, all other embodiments to those of ordinary skill in the premise of no creative efforts obtained, should be considered within the scope of protection of the present invention.

Figure 1:
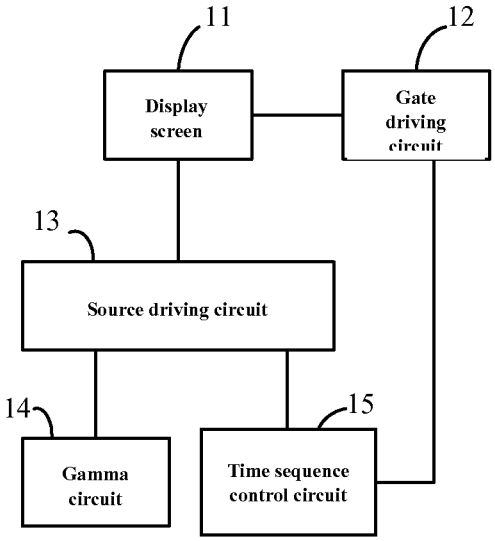
FIG. 1 is a structural diagram of a display device in one embodiment disclosed by the present invention.

Please refer to FIG. 1. The display device in one embodiment disclosed by the present invention comprises a display screen 11, and a gate driving circuit 12 and a source driving circuit 13 coupled to the display screen 11, a gamma circuit 14 and a time sequence control circuit 15. The time sequence control circuit 15 is employed to control the time sequence of the gate driving circuit 12 and the source driving circuit 13 for performing digital signal process to the pictures. The gamma circuit 14 is employed to generate reference voltages of gamma calibration required for the source driving circuit 13. The gate driving circuit 12 is employed to activate TFTs (Thin Film Transistor) row by row. The source driving circuit 13 is employed to transmit the gray scale voltage converted from the picture digital signals processed by the time sequence control circuit 15 after digital to analog conversion to the TFTs activated by the gate driving circuit 12. The specific circuit structures of the gate driving circuit 12, the source driving circuit 13 and the time sequence control circuit 15 are the same as prior art. The repeated description is omitted here. The improvement of the specific circuit structure to prior art by the present invention is mainly focusing the circuit structure improvement of the gamma circuit 14.

Figure 2:
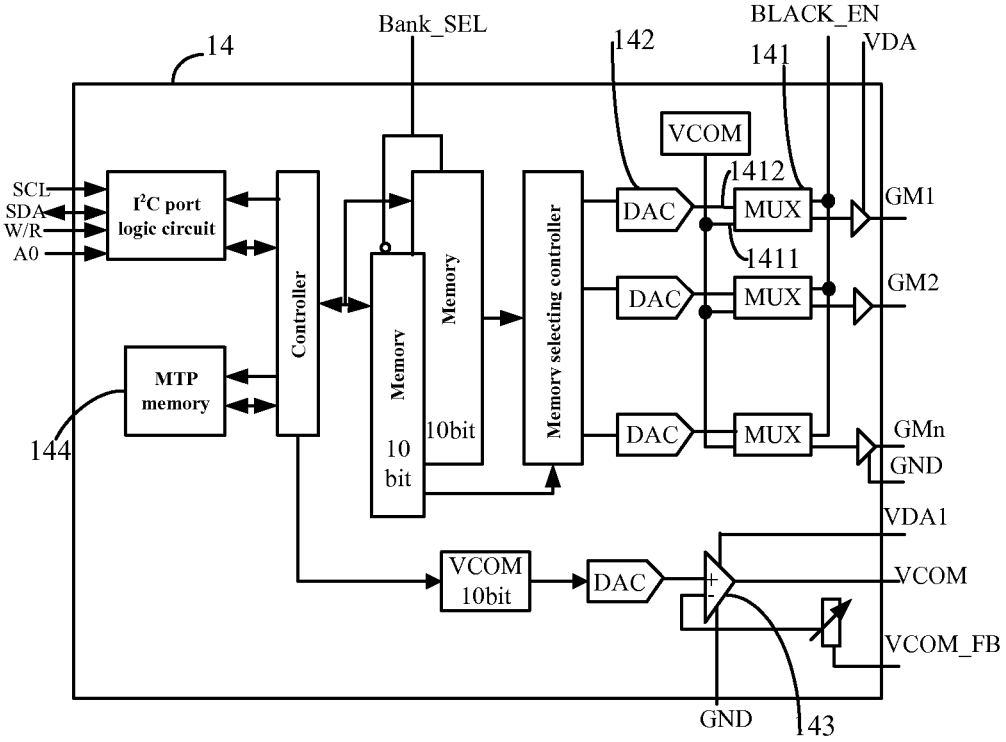
FIG. 2 is a specific circuit diagram of a gamma circuit in FIG. 1 according to the first embodiment disclosed by the present invention.

FIG. 2 is a specific circuit diagram of a gamma circuit 14 according to the first embodiment disclosed by the present invention. In comparison with prior arts, in this embodiment, the gamma circuit 14 comprises an either-or multiplex selector 141 (in FIG. 2, MUX represents the either-or multiplex selector 141) between a digital to analog conversion 142 (in FIG. 2, DAC represents the digital to analog conversion 142) and an operational amplifier 143 of the gamma circuit 14. The input data of the first input end 1411 of the either-or multiplex selector 141 is a VCOM voltage outputted by the gamma circuit 14, and input data of the second input end 1412 is a voltage converted from a predetermined value after digital to analog conversion stored in a multi time programmable (MTP) memory 144 of the gamma circuit 14. One general purpose input output (GPIO) port of the time sequence control circuit 15 is assigned to be a control port BIACK_EN of controlling output of the either-or multiplex selector 141, and the control end of the selector 141 is coupled to the control port BIACK_EN. Under control of the control port BIACK_EN, the selector 141 selects one of the input data of two input ends and transmits the same to the output end of the selector 141.

In this embodiment, as the time sequence control circuit 15 sets voltage level of the control port BIACK_EN to be low voltage level, i.e. the voltage level of the control end of the selector 141 is low voltage level, the selector 141 selects and outputs the input data of the first input end 1411, i.e. the VCOM voltage outputted by the gamma circuit 14. The outputted VCOM voltage is amplified by the operational amplifier 143 and then outputted to the source driving circuit 13 to be a first gamma reference voltage which is required as the source driving circuit 13 performs digital to analog conversion. The time sequence control circuit 15 does not output data as a gamma reference voltage required when the source driving circuit 13 performs digital to analog conversion is the first gamma reference voltage for realizing output of black frame insertion.

In the embodiment, under condition that the time sequence control circuit 15 does not output data, black frame insertion can be achieved to reduce the power consumption of the time sequence control circuit 15 and the source driving circuit 13, and thus to reduce the power consumption of the entire display device.

In this embodiment, as the voltage level of the control port BIACK_EN is set to be high voltage level, i.e. the voltage level of the control end of the selector 141 is high voltage level, the selector 141 selects and outputs the input data of the second input end 1412, i.e. the voltage converted from the predetermined value after digital to analog conversion in the MTP memory 144. The outputted voltage converted from the predetermined value after digital to analog conversion is amplified by the operational amplifier 143 and then outputted to the source driving circuit 13 to be a second gamma reference voltage which is required as the source driving circuit 13 performs digital to analog conversion. The time sequence control circuit 15 transmits a frame of normal image when the gamma reference voltage required as the source driving circuit 13 performs digital to analog conversion is the second gamma reference voltage.

Figure 3:
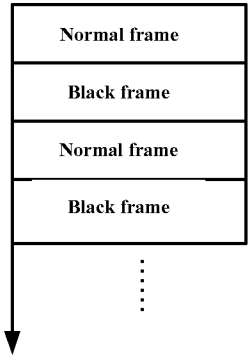
FIG. 3 is a diagram of an output of black frame insertion.

In this embodiment, the time sequence control circuit 15 sets voltage level of the control port BIACK_EN to be high voltage level as the display screen 11 requires outputting an odd frame of image, and sets voltage level of the control port BIACK_EN to be low voltage level as the display screen 11 requires outputting an even frame of image. Thus, an output of black frame insertion shown in FIG. 3 can be realized.

Figure 4:
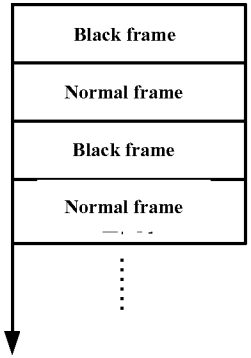
FIG. 4 is another diagram of an output of black frame insertion.

Certainly and Alternatively, the time sequence control circuit 15 sets voltage level of the control port BIACK_EN to be low voltage level as the display screen 11 requires outputting an odd frame of image, and sets voltage level of the control port BIACK_EN to be high voltage level as the display screen 11 requires outputting an even frame of image. Thus, an output of black frame insertion shown in FIG. 4 can be realized.

Figure 5:
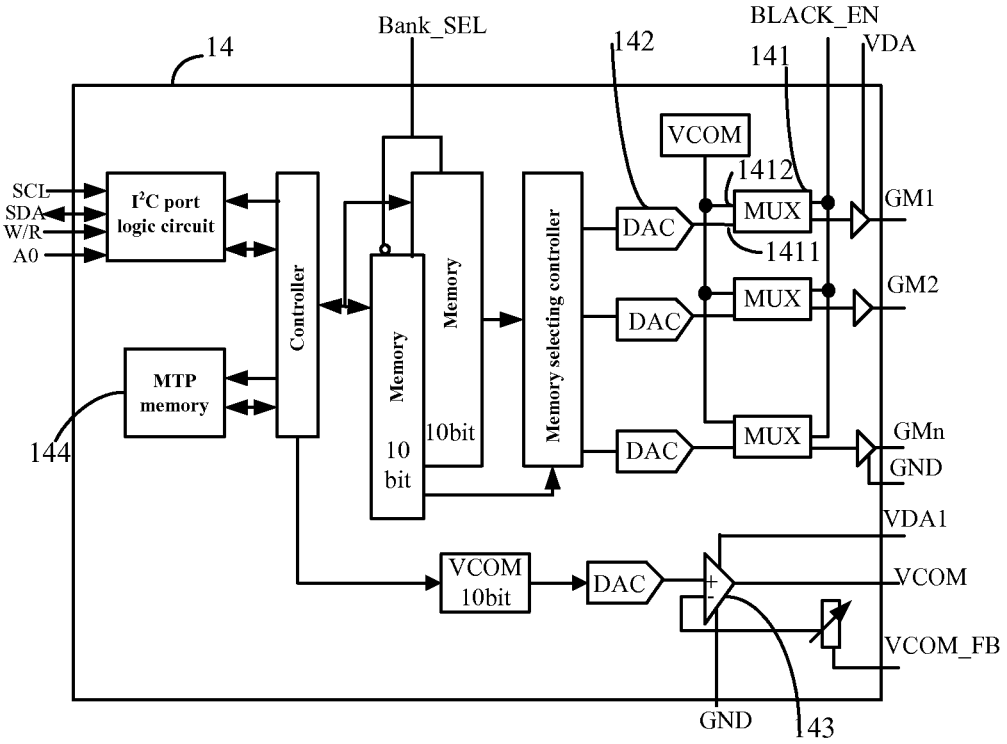
FIG. 5 is a specific circuit diagram of a gamma circuit in FIG. 1 according to the second embodiment disclosed by the present invention.

FIG. 5 is a specific circuit diagram of a gamma circuit 14 according to the second embodiment disclosed by the present invention. The difference from FIG. 2 is that in this embodiment, the input data of the first input end 1411 of the selector 141 is a voltage converted from the predetermined value after digital to analog conversion stored in the MTP memory 144 of the gamma circuit 14. The input data of the second input end 1412 is the VCOM voltage outputted by the gamma circuit 14.

Therefore, the difference from FIG. 2 is that in this embodiment, as the time sequence control circuit 15 sets voltage level of the control port BIACK_EN to be high voltage level, i.e. the voltage level of the control end of the selector 141 is high voltage level, and the selector 141 selects and outputs the input data of the second input end 1412, the output data is the VCOM voltage of the gamma circuit 14. The outputted VCOM voltage is amplified by the operational amplifier 143 and then outputted to the source driving circuit 13 to be a first gamma reference voltage which is required as the source driving circuit 13 performs digital to analog conversion. The time sequence control circuit 15 does not output data as a gamma reference voltage required when the source driving circuit 13 performs digital to analog conversion is the first gamma reference voltage for realizing output of black frame insertion.

As the time sequence control circuit 15 sets the voltage level of the control port BIACK_EN to be low voltage level, i.e. the voltage level of the control end of the selector 141 is low voltage level, the selector 141 selects and outputs the input data of the first input end 1411, the output data is the voltage converted from the predetermined value after digital to analog conversion in the MTP memory 144. The outputted voltage converted from the predetermined value after digital to analog conversion is amplified by the operational amplifier 143 and then outputted to the source driving circuit 13 to be a second gamma reference voltage which is required as the source driving circuit 13 performs digital to analog conversion. The time sequence control circuit 15 transmits a frame of normal image when the gamma reference voltage required as the source driving circuit 13 performs digital to analog conversion is the second gamma reference voltage.

In this embodiment, the time sequence control circuit 15 sets voltage level of the control port BIACK_EN to be low voltage level as the display screen 11 requires outputting an odd frame of image, and sets voltage level of the control port BIACK_EN to be high voltage level as the display screen 11 requires outputting an even frame of image. Thus, an output of black frame insertion shown in FIG. 3 can be realized.

Certainly and Alternatively, the time sequence control circuit 15 sets voltage level of the control port BIACK_EN to be high voltage level as the display screen 11 requires outputting an odd frame of image, and sets voltage level of the control port BIACK_EN to be low voltage level as the display screen 11 requires outputting an even frame of image. Thus, an output of black frame insertion shown in FIG. 4 can be realized.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A display device capable of performing black frame insertion, comprising a display screen, and a gate driving circuit and a source driving circuit coupled to the display screen, a gamma circuit and a time sequence control circuit, wherein the gamma circuit comprises an either-or multiplex selector, and input data of one input end of the either-or multiplex selector is a VCOM voltage outputted by the gamma circuit, and input data of the other input end is a voltage converted from a predetermined value after digital to analog conversion stored in a multi time programmable memory of the gamma circuit, and one general purpose input output port of the time sequence control circuit is assigned to be a control port of controlling output of the either-or multiplex selector, and as the either-or multiplex selector selects the VCOM voltage outputted by the gamma circuit under control of the control port, the outputted VCOM voltage is amplified by an operational amplifier in the gamma circuit and then outputted to the source driving circuit to be a first gamma reference voltage which is required as the source driving circuit performs digital to analog conversion, and the time sequence control circuit does not output data as a gamma reference voltage required when the source driving circuit performs digital to analog conversion is the first gamma reference voltage for realizing output of black frame insertion and reducing power consumption of the time sequence control circuit and the source driving circuit.

2. The display device capable of performing black frame insertion according to claim 1, wherein as the either-or multiplex selector selects outputting the voltage converted from the predetermined value after digital to analog conversion in the multi time programmable memory of the gamma circuit under control of the control port, the outputted voltage after digital to analog conversion is amplified by the operational amplifier and then outputted to the source driving circuit to be a second gamma reference voltage which is required as the source driving circuit performs digital to analog conversion, and the time sequence control circuit transmits normal images when the gamma reference voltage required as the source driving circuit performs digital to analog conversion is the second gamma reference voltage.

3. The display device capable of performing black frame insertion according to claim 2, wherein the either-or multiplex selector selects outputting the VCOM voltage outputted by the gamma circuit as the control port is set to be low voltage level, and selects outputting the voltage converted from the predetermined value after digital to analog conversion in the multi time programmable memory of the gamma circuit as the control port is set to be high voltage level.

4. The display device capable of performing black frame insertion according to claim 3, wherein the time sequence control circuit sets voltage level of the control port to be high voltage level as the display screen requires outputting an odd frame of image, and sets voltage level of the control port to be low voltage level as the display screen requires outputting an even frame of image.

5. The display device capable of performing black frame insertion according to claim 3, wherein the time sequence control circuit sets voltage level of the control port to be low voltage level as the display screen requires outputting an odd frame of image, and sets voltage level of the control port to be high voltage level as the display screen requires outputting an even frame of image.

6. The display device capable of performing black frame insertion according to claim 2, wherein the either-or multiplex selector selects outputting the VCOM voltage outputted by the gamma circuit as the control port is set to be high voltage level, and selects outputting the voltage converted from the predetermined value after digital to analog conversion in the multi time programmable memory of the gamma circuit as the control port is set to be low voltage level.

7. The display device capable of performing black frame insertion according to claim 6, wherein the time sequence control circuit sets voltage level of the control port to be high voltage level as the display screen requires outputting an odd frame of image, and sets voltage level of the control port to be low voltage level as the display screen requires outputting an even frame of image.

* * * * *